United States Patent [19]

Pence

[11] Patent Number: 4,855,881

[45] Date of Patent: Aug. 8, 1989

[54] OPTIONALLY ILLUMINATING HANDLE

[76] Inventor: James F. Pence, 7826 170th St. West, Lakeville, Minn. 55044

[21] Appl. No.: 248,648

[22] Filed: Sep. 26, 1988

[51] Int. Cl.[4] ..... A45C 15/06

[52] U.S. Cl. ..... 362/156; 362/191; 362/154

[58] Field of Search ..... 362/154, 156, 190, 191, 362/208, 155

[56] References Cited

U.S. PATENT DOCUMENTS

| | | | |
|---|---|---|---|
| 2,053,385 | 9/1936 | Tyrell | 362/156 |
| 2,334,084 | 11/1943 | Gold et al. | 362/156 |
| 2,538,151 | 1/1951 | Grasak | 362/156 X |
| 2,554,603 | 5/1951 | Terlinde | 362/156 X |
| 3,231,730 | 1/1966 | Wagner | 362/154 |
| 3,346,733 | 10/1967 | Woolworth | 240/6.4 |
| 3,938,132 | 2/1976 | Cunningham | 340/321 |
| 4,656,566 | 4/1987 | Kelley | 362/202 |

FOREIGN PATENT DOCUMENTS

| | | | |
|---|---|---|---|
| 627667 | 8/1949 | United Kingdom | 362/156 |
| 883546 | 11/1961 | United Kingdom | 362/156 |

*Primary Examiner*—Ira S. Lazarus
*Assistant Examiner*—Peggy Neils

[57] ABSTRACT

A container handle designed to hold a separate flashlight so that the beam of the accessory flashlight may be aimed by the carrier to illuminate his path and surrounding area or directed against a mirrored surface and reflected into the container thereby illuminating its contents.

1 Claim, 2 Drawing Sheets

OPTIONALLY ILLUMINATING HANDLE

BACKGROUND

1. Field of Invention

This invention relates to container handles, specifically to a handle which can hold a separate flashlight and, at the carrier's option, illuminate either the carrier's path and immediate area or the interior of the container.

2. Description Of Prior Art

At any given moment, one-half of the earth's surface is in the dark. People who must carry things at night—fishermen with tackle boxes, sportsmen with cooler chests, tradesmen with tool boxes, paramedics with emergency equipment—often have both hands filled and find it difficult to carry an additional light.

The battery powered flashlight is well known. Usually, when such a flashlight was added to a container it was made an integral part of the unit to illuminate its exterior, such as the THERMO LIGHT at U.S. Pat. No. 4,656,566, its interior, such as the LIGHTED TACKLE BOX at U.S. Pat. No. 3,346,733, or both the exterior and the interior, such as the ILLUMINATED FISHING TACKLE BOX at U.S. Pat. No. 3,938,132.

There are a number of disadvantages in making the light a part of the container. Such an installation makes the container more complicated to produce and needlessly expensive for those consumers who do not require illumination. The necessary batteries occupy needed space inside the container. Worst of all, the flashlight cannot be used apart from the container.

OBJECTS AND ADVANTAGES

Accordingly, several objects and advantages of my invention are that it is simpler to manufacture and has more available interior space since it has no batteries or electrical apparatus of its own. It is less expensive for the purchaser who does not desire illumination and less subject to expensive repair since the flashlight is easily replaced if defective. It illuminates the container's contents with both the owner's hands free to work and still allows the owner to use his flashlight for other purposes totally separate from the container.

DRAWING FIGURES

DESCRIPTION OF INVENTION

Figure 1:
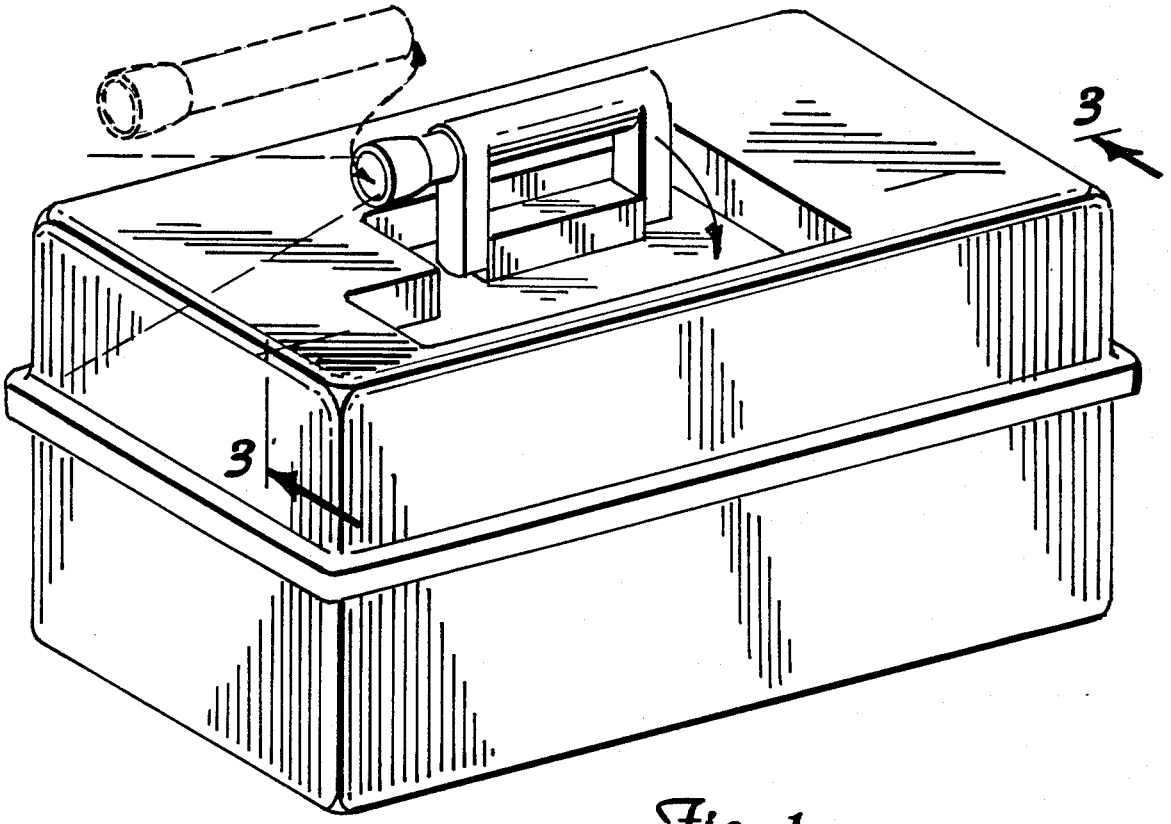
FIG. 1 shows such handle holding a flashlight in its upright position.
Figure 3:
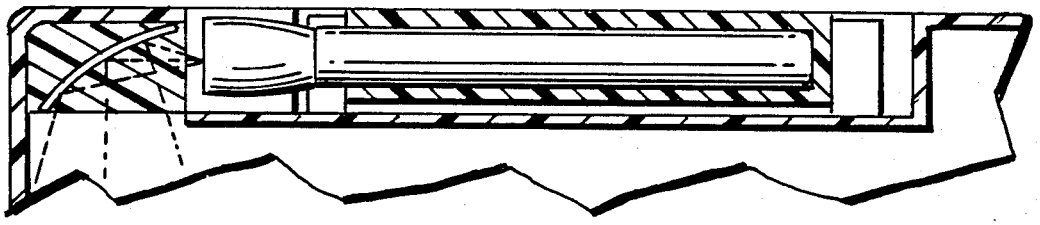
FIG. 3 shows a side sectional view of FIG. 1 at 3—3 with such handle down with its accompanying flashlight aimed at the mirrored surface.

FIG. 1 shows a tubular carrying handle designed to hold a flashlight by means of a friction fit such as ribs, elastic O-rings or screw tension. The handle is swing mounted as shown or pops straight up into position for carrying its attached container.

Figure 2:
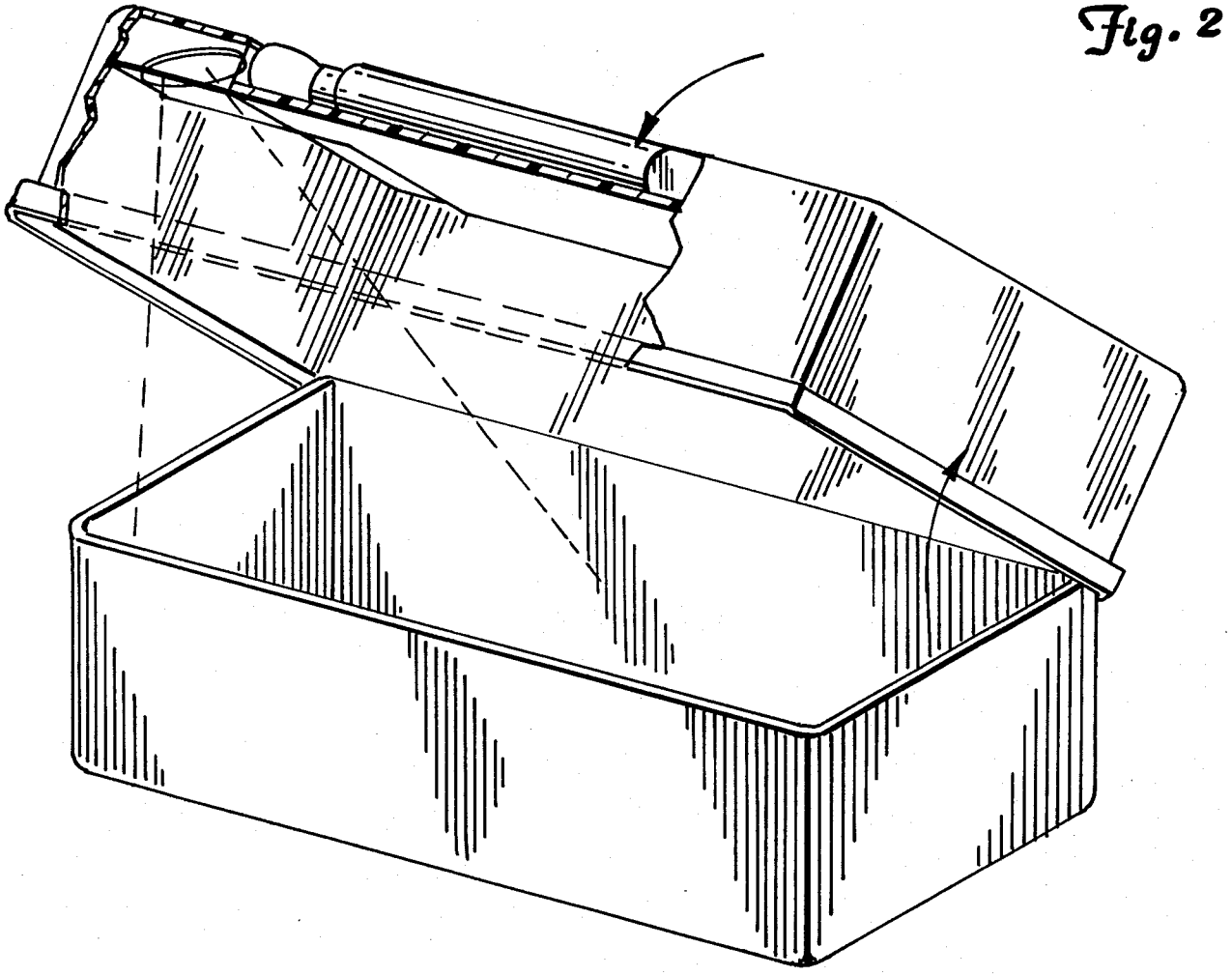
FIG. 2 shows a cutaway view of such handle in its downward position.

When not used for carrying, the handle drops by spring tension, muscular action, or gravity, into a recess in the surface of the container where it is unobtrusive as shown in FIG. 2 and its accompanying flashlight is aimed at a mirrored surface. When the flashlight is activated, its beam is reflected off the mirrored surface to illuminate the interior of the container. The mirrored surface can be flat, concave, or convex depending on the type of illumination desired. To ease manufacturing and insure the waterproof integrity of the container, the mirrored surface would probably be set in a clear block of plastic that would supply a light entrance window and a light exit window in one easily sealed unit.

OPERATION OF THE INVENTION

When the handle is in its upright position as shown in FIG. 1, it is grasped in the hand and used to carry the container. With the addition of a flashlight inserted into the handle, the carrier can illuminate his path and immediate area. When the handle and its accompanying flashlight are pushed down by gravity, self-actuating spring tension, or muscular action of the carrier, it fits a recess as shown in FIG. 2 and the beam of the flashlight is reflected off a mirrored surface thereby illuminating the contents and interior of the container. When not needed with the container, the flashlight is easily removed and used separately.

Thus the reader will see that the handle of this invention provides a reliable source of light for anyone, of any age, who may be carrying a container or working with its contenst in the dark. Although shown in FIG. 1 as part of the top of the container, it could just as advantageously be mounted on the sides of larger chests requiring both hands. The handle could be swing mounted as shown or pulled straight up into its carrying position. Accordingly, the scope of the invention should be determined not by the embodiments illustrated but by the appended claims and their legal equivalents.

We claim:

1. A flashlight in combination with a container for illuminating the area surrounding the container and the interior thereof, comprising:

(a) a handle attached to a surface of said container of sufficient size to accommodate a human hand, (b) said flashlight inserted into said handle, (c) said handle is attached to the surface of said container to provide a position suitable for carrying said container with the hand while simultaneously aiming the flashlight to direct a beam of light, (d) said surface of the container is formed with a recess therein, and (e) said handle fitting into said recess when not used for carrying the container and directing the beam of the flashlight through a window aperture in said surface to a light conductive or reflective surface so as to illuminate an interior of said container and its contents.

* * * * *